US010859071B2

(12) United States Patent
Jones

(10) Patent No.: US 10,859,071 B2
(45) Date of Patent: Dec. 8, 2020

(54) ROTARY TRAVELING VALVE

(71) Applicant: Stinger Oil Tools LLC, Houston, TX (US)

(72) Inventor: Roy Jones, Cypress, TX (US)

(73) Assignee: STINGER OIL TOOLS LLC, Houston, TX (US)

( * ) Notice: Subject to any disclaimer, the term of this patent is extended or adjusted under 35 U.S.C. 154(b) by 140 days.

(21) Appl. No.: 16/239,928

(22) Filed: Jan. 4, 2019

(65) Prior Publication Data

US 2020/0056607 A1 Feb. 20, 2020

Related U.S. Application Data

(60) Provisional application No. 62/718,564, filed on Aug. 14, 2018.

(51) Int. Cl.
*F04B 7/00* (2006.01)
*E21B 34/14* (2006.01)

(52) U.S. Cl.
CPC ..... *F04B 7/0049* (2013.01); *E21B 34/14* (2013.01)

(58) Field of Classification Search
CPC .... F04B 7/0049; F04B 7/0046; F04B 7/0061; E21B 34/12; E21B 34/126; E21B 2200/06; F16K 31/50
USPC ..... 417/545, 555.2
See application file for complete search history.

(56) References Cited

U.S. PATENT DOCUMENTS 4,452,423 A * 6/1984 Beblavi ..... F16K 1/02 251/129.11
4,534,715 A 8/1985 Jones
4,629,402 A 12/1986 Marshala
4,789,132 A * 12/1988 Fujita ..... F16K 1/12 251/129.11
5,292,236 A * 3/1994 Graffin ..... F04B 53/122 417/510
5,628,624 A 5/1997 Nelson
5,893,708 A 4/1999 Nelson
6,007,314 A 12/1999 Nelson, II
6,840,200 B2 * 1/2005 Miller ..... F01L 9/04 123/188.4
8,226,386 B2 7/2012 Cifuentes
9,790,932 B2 * 10/2017 Bagagli ..... F16K 3/10
(Continued)

*Primary Examiner* — Charles G Freay
(74) *Attorney, Agent, or Firm* — D'Ambrosio & Menon, PLLC; Usha Menon

(57) ABSTRACT

A rotary traveling valve for subterranean pumping system is disclosed herein. The traveling valve includes a rotary lock configured for back and forth rotary motion in response to up stroke and down stroke movements of a driver. The bottom face of the rotary lock rests against a seating face of a housing of the valve, and a fluid passage in the seating face is opened due to rotary motion of the rotary lock during a down stroke movement of the driver, and closed during an up stoke movement of the driver. The bottom face of the rotary lock is pressed against the sealing face by a back pressure spring to prevent excessive bottom pressure to cause pumping interruption due to gas and fluid blow-by through the valve. It also compensates for any wear that may take place on the two surfaces. In addition traveling valve incorporates bearing balls to minimize friction between moving parts such as driver and housing as well as between driver and rotary lock.

10 Claims, 2 Drawing Sheets

(56) References Cited

U.S. PATENT DOCUMENTS

| | | | | |
|---|---|---|---|---|
| 9,915,354 | B2 * | 3/2018 | Kelly | F16K 3/08 |
| 10,683,860 | B2 * | 6/2020 | Voser | F16K 15/18 |

* cited by examiner

SECTION A-A

SECTION B-B

SECTION C-C

ENLARGED VIEW D

ROTARY TRAVELING VALVE

CROSS-REFERENCE TO RELATED APPLICATION

This application claims priority from U.S. Provisional Patent Application No. 62/718,564 filed on Aug. 14, 2018, the entire disclosure of which is considered to be part of the disclosure of the present application, and is hereby incorporated by reference in its entirety.

FIELD OF INVENTION

This disclosure is directed to sub-surface pumps used in production oil wells, and in particular to traveling valves used in subterranean reciprocating piston pumps.

BACKGROUND

The background description includes information that may be useful in understanding the present invention. It is not an admission that any of the information provided herein is prior art or relevant to the presently claimed invention, or that any publication specifically or implicitly referenced is prior art.

In producing oil wells, it is common practice to provide a pump at the bottom of the well bore or at least down the well in the producing formation. The pump is normally actuated by reciprocation of the pump plunger by sucker rods which extend through the well bore from a reciprocating device at the surface of the ground and into connection with the pump. The reciprocating device at the surface is usually a horsehead type pump and alternately raises and lowers the string of sucker rods in the well bore.

It is frequently necessary during the pumping operation to pull the pipe or casing from the well to repair or replace the parts of the pump. This can be very costly and time consuming. Pump failure and resulting fluid loss may be caused by wear, sand packing in the ports and moving parts, and excessive gas pressures.

Reciprocating piston pumps are well known in the art and are commonly used in onshore wells to mechanically lift liquid out of wells where enough bottom-hole pressure does not exist for the liquid to flow by itself all the way to the surface. Down-hole reciprocating piston pumps are located at bottom of tubing of oil well and have two check valves: a stationary valve, also known as a standing valve, at the bottom of a tubing/borehole; and a "traveling" valve on the piston connected to the bottom of sucker rods that travels up and down as the sucker rods reciprocate. Reservoir fluid enters from formation into the bottom of the borehole through perforations that have been made through the casing and cement. When the piston travels up, the traveling valve is closed and the standing valve is opened causing the pump barrel to fill with fluid. When the piston begins pushing down, the traveling valve opens and the standing valve closes causing the traveling valve to drop through the fluid in the barrel which had been sucked in during the upstroke. The piston then reaches end of its stroke and begins its path upwards again, repeating the process.

Various types of traveling valves are known in the art. For example, U.S. Pat. No. 4,534,715 discloses a traveling valve assembly for use in a subsurface gravity type pumping system that inter alia includes a rotary valve incorporating a beveled rotary valve member and a conical valve seat, wherein responsive to reciprocating motion, the rotary valve member rotates relative to the valve seat between open and closed positions. Reciprocating motion is converted to rotary motion by means of a journaled spiral groove in the rotary valve. It also uses fluid pressure to manipulate a ball member and a slidable seal member relative to corresponding seat members between open and closed positions. The traveling valve does not incorporate any means for forced contact of the beveled rotary valve member against the conical valve seat to prevent leakage through gap between them and compensate for wear that may occur on these surfaces over a period of usage. Therefore, it employs a number of seals. Further, the rotary valve incorporates a number of components and seals making it very complicated with attended complications in its manufacture and corresponding cost implications.

U.S. Pat. No. 4,629,402 discloses a traveling valve assembly that is actuated by reciprocating movement of a sucker rod. The valve assembly comprises a rotatable fluid port assembly comprising a fixed first ported member and a rotatable second ported member resting on flat surface of the first ported member. A reciprocating actuator member incorporates a screw rod portion that engages with a gear bore in the second ported member of the fluid port assembly to rotate the second ported member in one direction during its downstroke movement to open fluid ports of the fluid port assembly and to rotate the second ported member in an opposite direction during the upstroke movement to close the fluid ports. The barrel assembly further incorporates an additional beveled fluid port at its upper end that is opened and closed by the actuator member during downstroke and upstroke positions respectively of the actuator member. The rotary action of the second ported member is created by metal to metal sliding action between the screw rod portion and the gear bore which results in wear besides inefficient energy transfer on account of friction. Further, there are no means to ensure that the second ported member is in constant contact with the first ported member to prevent any leakage through the gap between them and to compensate for wear that may occur on these surfaces. This in due course of time may result in leakage through the gap between them.

U.S. Pat. No. 8,226,386 discloses a ball and seat based check valve with multiple fluid ports that work in a reverse pumping action that transfers fluid through the tubing, or alternatively through the casing to avoid need to support weight of fluid column reducing stress on the sucker rods, reduce size of driving unit and infrastructure for its transportation and maintenance. As the traveling valve is based on a ball and seat arrangement, it works based on hydraulic pressure difference on the two sides of the valve and therefore is susceptible to gas interference.

U.S. Pat. Nos. 5,628,624, 5,893,708 and 6,007,314 disclose different aspects of a Dartt® traveling valve arranged within a down-hole pump where adequate force to lift a ball off valve seat is ensured by using an actuator. The opening and closing of a traveling valve is dependent on hydrostatic pressure difference and is made more sensitive to the pressure difference. However, it is still susceptible to gas interference.

Thus, existing traveling valves are either of ball and seat type referred to as a check valves that function based on hydraulic pressure difference between two sides of the valve, or rotary types where conversion of reciprocating action to rotary action is used to open and close a fluid passage without depending on hydraulic pressure difference between two sides of the valve. The check valves are susceptible to gas interference, commonly known as gas pound. If the well has significant amounts of gas released from the formation, the gas can accumulate above the fluid level in the tubing which will not release the current check valve on its downstroke resulting in no fluids being pumped to the surface. In the rotary type valves, due to the mechanical actuation of opening and closing, gas cannot interfere with the opening and closing of the valve which allows fluids to be continuously pumped on every stroke of production string. However, rotary valve type traveling valves suffer from drawbacks that cause wear thereby affecting their performance and requiring down-hole pumps to be subjected to repairs resulting in stoppage of pumping and corresponding losses.

There is a need for an improved traveling valve that actuates between closed and open positions based on reciprocating motion of the sucker rod.

SUMMARY

A novel rotary traveling valve (also interchangeably referred to hereinafter as "rotary valve") can be provided to solve the limitations of conventional traveling valves. In an embodiment, the rotary traveling valve includes a rotary lock which can be seated against a seating face to prevent any leakage through the gap between them. It also acts to compensate for any wear thereby enhancing the life of the rotary valve and the period between maintenance.

According to an embodiment, a rotary lock can be kept seated against its seating face by incorporating a back pressure spring that can be housed in a spring retainer. The back pressure spring can rest against the rotary lock to keep it pushed against its seating face. Thus, wear on the rotary lock and the seating face can get compensated by a push of the back pressure spring. The back pressure spring can also prevent excessive bottom pressure to cause pumping interruption due to gas and fluid blow-by through the rotary valve. In addition, the retainer spring and the back pressure spring can also prevent longitudinal movement of the rotary lock during up stroke of actuating parts.

According to an embodiment, a bearing can be provided as an interface between the back pressure spring and the rotary lock so that the rotary lock can rotate freely despite the stationary back pressure spring pushing against it.

In an embodiment, the rotary valve can incorporate a driver for minimizing any friction between moving parts. The driver can provide reciprocating motion for conversion to rotary motion to rotate the rotary lock, and a housing that houses the driver and the rotary lock. Similar friction reducing means can be provided between the driver and the rotary lock. Reduced friction between moving parts enables energy efficient and smooth functioning of the rotary valve without appreciable frictional wear and thus, prolonging the life of the rotary valve.

According to an embodiment, a set of driver alignment bearing balls can be provided between the driver and the housing configured in a set of longitudinal grooves in the driver as a means for reducing friction. The set of driver alignment bearing balls between the driver and the housing eliminates metal-to-metal sliding movement between them and thus minimizing wear. It can also reduce friction between the two thus making the movement energy efficient. The combination of the bearing balls and longitudinal grooves can also enable relative longitudinal movement between the driver and the housing within a pre-set limit which can be determined by the length of the longitudinal grooves. The rotary valve further incorporates means to concentrically align the rotary lock relative to the driver.

According to an embodiment, a set of rotary lock bearing balls can be provided between the driver and rotary lock as a further means to reduce friction. The set of rotary lock bearing balls can be provided at fixed locations within a bore in the driver. The set of rotary lock bearing balls can engage with a set of identical helical grooves located on an outer periphery of the rotary lock. The interaction between the set of helical grooves and the set of rotary lock bearing balls, as the rotary lock bearing balls undergoes upward and downward reciprocating movement along with the driver, can provide back and forth rotary movement to the rotary lock between a closed position and an open position of the rotary valve.

Various objects, features, aspects and advantages of the rotary valve will become more apparent from the following detailed description of preferred embodiments, along with the accompanying figures in which like numerals represent like components.

DETAILED DESCRIPTION

Figure 1A:
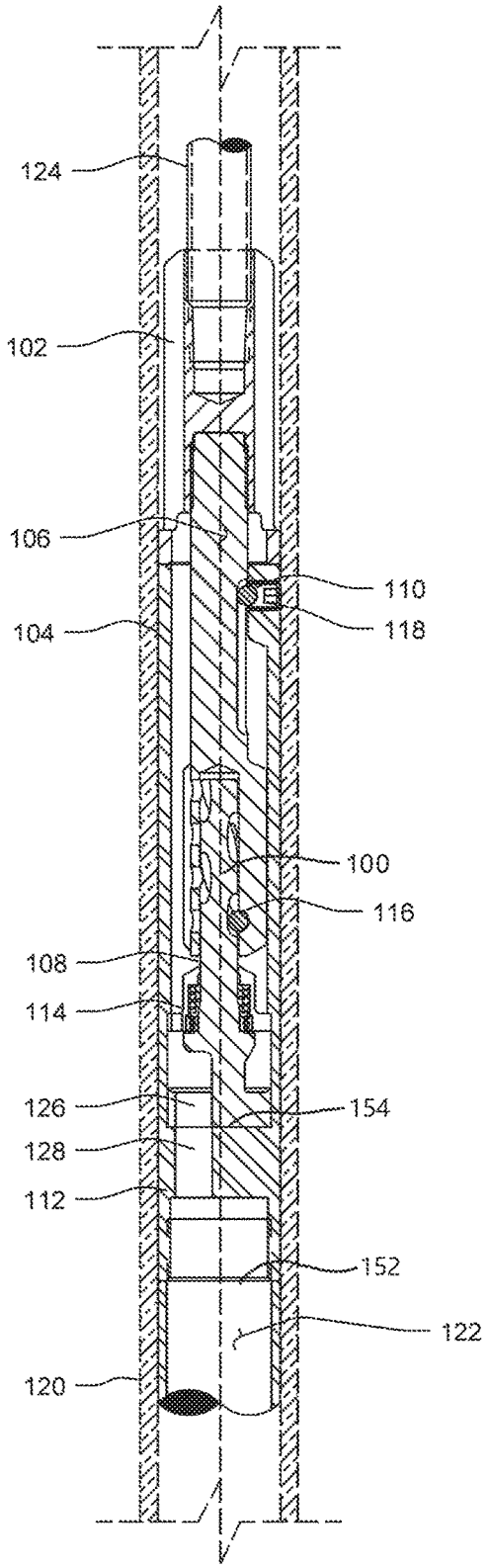
FIGS. 1A and 1B illustrate exemplary sectional views of a traveling valve in open and closed positions respectively in accordance with various embodiments.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined, it should be given the broadest definition persons in the pertinent art have given that term as reflected in printed publications and issued patents at the time of filing.

Conventional traveling valves are of either ball and seat type referred to as a check valves or rotary types. The check valves function based on hydraulic pressure difference between two sides of the valve. As such, they are susceptible to gas interference, commonly known as gas pound. Gas pound occurs when the well has a significant amount of gas released from the formation which gets accumulated above the fluid level in the tubing. The accumulated gas does not allow release of the current check valve on its down stroke resulting in stoppage of fluid pumping to the surface.

On the other hand, rotary type traveling valves, being mechanically driven, do not suffer from gas pound allowing fluids to be continuously pumped on every stroke of the production string. Further, they may be deployed in any orientation as against check valves that have to be vertically oriented to enable movement of ball under gravity. However, conventional rotary valve type traveling valves suffer from drawbacks that cause wear. They also do not include any mechanism that may compensate the wear and prolong life of the valve. It affects their performance requiring repairs resulting in stoppage of pumping and corresponding losses. There is, therefore, a need for an improved rotary type traveling valve.

The present disclosure is directed to an improved rotary valve that can lock to prevent high-pressure gas from blowing through the pump while pumping. At the same time, a rotary lock mechanism allows excess gases to be expelled out of the fluid column to ensure continuous pumping and an uninterrupted flow of oil in the pumping system, thereby improving recovery from formation/reservoir on account of uninterrupted operation.

Another objective of the present disclosure is to extend the longevity of the overall well pumping system by providing means that result in reduced wear between the moving parts as well as means that compensate for any wear that may take place between the rotary lock and its seating face thereby prolonging life of the pumping system.

Figure 1B:
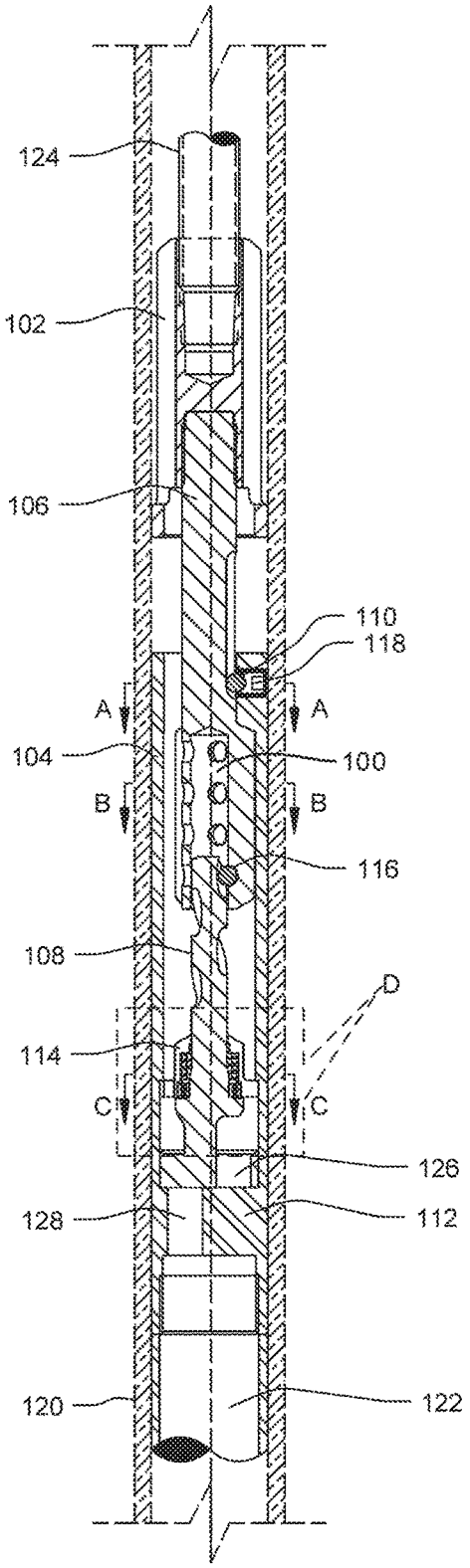

Referring now to FIGS. 1A and 1B, where exemplary sectional views of rotary lock traveling valve 100 in open and closed conditions respectively are disclosed in accordance with various embodiments herein. The rotary valve 100 includes a rod connector 102 that connects functional parts of the rotary valve to an artificial lift system commonly known as a sucker rod. Rod connector 102 can incorporate internal API threads at its two ends for facilitating the connection. In an implementation, the rod connector can connect the sucker rod 124 to a driver 106 of the rotary valve 100.

The rotary valve 100 further includes a housing. The housing includes an upper housing 104 and a lower housing 112. The housing can be located within a pump string tubing 120. The upper housing 104 is configured to be hollow in order to contain and control the driver 106 and a rotary lock 108 as shown in FIGS. 1A and 1B. The lower housing 112 incorporates a substantially flat seating face 154 that incorporates a passage 128 opening in an opening bore below the flat seating face. The passage 128 provides a path for fluid to pass from below to upper side of the lower housing 112. The lower housing 112 can have API threads on the bottom of the housing for other API attachments such as a plunger 122, which is a part of the standard pumping string.

Figure 2:
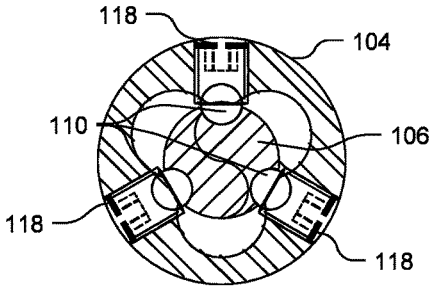
FIG. 2 illustrates an exemplary sectional view showing details of a set of driver alignment bearing balls between a driver and housing along with an alignment mechanism in accordance with an embodiment.

The driver 106 can be located within a bore of upper housing 104 through a set of longitudinal grooves and a set of driver alignment bearing balls in corresponding positions that enable relative movement between the two free from metal-to-metal sliding contact. This can reduce friction and wear. The driver 106 can incorporate a plurality of equally-spaced longitudinal grooves on its outer circumference. For example, the driver 106 can incorporate at least three longitudinal/spiral polished timing grooves. The grooves are cut specifically for timing to allow the rotary lock to rotate as part of timed rotation. The driver 106 can further incorporate a set of driver alignment bearing balls 110. For example, the driver 106 can incorporate a set of at least three driver alignment bearing balls 110. The set of longitudinal grooves and driver alignment bearing balls can be located in the upper housing 104 in matching positions. The upper housing 104 can have radial holes in which the driver alignment bearing balls 110 can be located such that they protrude out towards the inside of the upper housing 104 and engage in the grooves as shown in section A-A in FIG. 2. The radial position of the driver alignment bearing balls 110 can be adjusted by alignment set screws 118 to align the position of the driver 106 concentric to the upper housing 104.

The combination of longitudinal/spiral polished timing grooves and driver alignment bearing balls 110 ensures that the driver 106 does not rotate relative to the upper housing 104 but can have relative linear motion in longitudinal direction with minimal friction and wear. The rod connector 102 and driver 106 make contact with the upper housing 104 using the body of the upper housing for strength to pull fluid to the surface. The travel length is determined by the spiral groove on the rotary in which the distance from the bottom of the rod connector and top of the driver correlates the angle to open and closed position.

The longitudinal grooves along with the driver alignment bearing balls 110 also maintain proper alignment of the driver 106 in relation to the upper housing 104. They further ensure efficient transfer of energy between upper housing 104 and the driver 106 on account of reduced friction.

The driver 106 can incorporate one or more passages for fluid to flow from its lower side to upper side.

Figure 3:
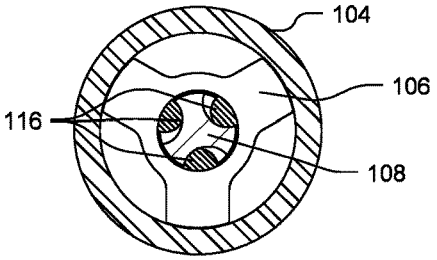
FIG. 3 illustrates an exemplary sectional view showing details of a set of rotary lock bearing balls between the driver and rotary lock in accordance with an embodiment.

The rotary lock 108 can be located in a bore in driver 106 by means of a set of rotary lock bearing balls 116. The rotary lock 108 can incorporate a plurality of identical helical grooves on its outer periphery and the set of rotary lock bearing balls 116 located along surface of a bore in the driver 106 can engage with the helical grooves as shown in section B-B in FIG. 3. The rotary lock 108 is constrained from any linear motion relative to the housing so that when the set of rotary lock bearing balls 116 moves up and down along with the driver 106, they cause the rotary lock 108 to rotate back and forth.

The rotary lock 108 can incorporate a flat bottom face 152 that sits over the flat surface of lower housing 112 and can also incorporate a passage 126 for fluid to flow through when the passage 126 is in alignment with passage 128 in the lower housing 112. The orientation of the driver 106, the rotary lock 108 and the housing—both upper and lower 104/112—can be such that the passages 126 and 128 align with each other as shown in FIG. 1B, to enable passage of fluid when the rotary lock 108 is rotated during the down stroke of the driver 106. On the other hand, the configuration ensures that the passages 126 and 128 do not overlap with each other as shown in FIG. 1A, to block passage of fluid when the rotary lock is rotated during up stroke of the driver 106.

The flat bottom face 152 of the rotary lock 108 and the flat surface of lower housing 112 can be hardened to minimize wear during their relative movement. Both surfaces can also be given a smooth finish and subjected to a finishing operation such as lapping to maximize mutual contact area.

A set of rotary lock bearing balls 116 ensures proper alignment of rotary lock 108 to the lower housing 112 and allows efficient transfer of energy between driver 106 and the rotary lock 108 due to reduced friction.

Figure 4:
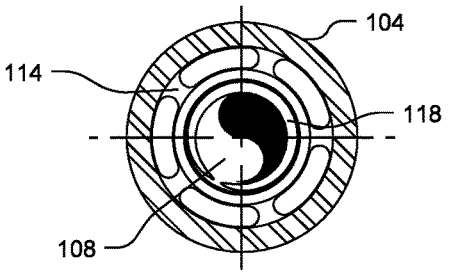
FIG. 4 illustrates an exemplary sectional view showing details of a spring retainer and a back pressure spring in accordance with an embodiment.
Figure 5:
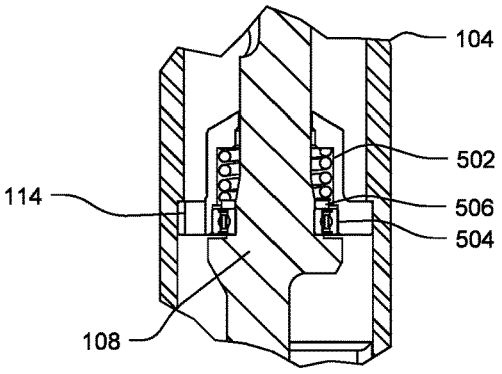
FIG. 5 illustrates an enlarged view showing further details of a spring retainer, back pressure spring and bearing between the back pressure spring and rotary lock in accordance with an embodiment.

The rotary traveling valve 100 also incorporates means to keep the rotary lock 108 forced against its seating face 154. FIGS. 4 and 5 illustrate exemplary sectional and enlarged views respectively showing means to keep rotary lock 108 forced against seating face which is a back pressure spring 502 housed in a spring retainer 114. The back pressure spring 502 rests against the rotary lock 108 to keep it pushed against its seating face. Thus, any wear that may take place on the two faces gets compensated by push of the back pressure spring 502. The back pressure spring 502 can also prevent excessive bottom pressure to cause pumping interruption due to gas and fluid blow-by through the valve. In addition, the spring retainer 114 and the back pressure spring 502 also prevent longitudinal movement of the rotary lock during up stroke of actuating parts which is essential to convert linear movement of the driver 106 to rotary movement of the rotary lock 108.

A bearing 504 and a washer 506 are also provided between back pressure spring 502 and the rotary lock so that the rotary lock 108 can rotate freely in spite of the stationary back pressure spring 502 pushing against it.

Thus, the rotary traveling valve disclosed herein overcomes drawbacks of conventional traveling valves. In particular, it provides a traveling valve that can lock to prevent high-pressure gas from blowing through the pump while pumping thus ensuring continuous pumping and uninterrupted flow of oil in the pumping system, thereby improving recovery from formation/reservoir on account of uninterrupted operation. It also provides means that result in reduced wear between moving parts as well as means that compensate any wear that may take place between rotary lock and its seating face thereby prolonging life of the pumping system.

The disclosed embodiments may be implemented within the same traveling valve or within separate traveling valves to support the various techniques described in this disclosure. Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified, thus fulfilling the written description of all Markush groups used in the appended claims.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The invention claimed is:

1. A traveling rotary valve for subterranean pumping systems, the valve comprising:

a housing, wherein the housing comprises an upper housing and a lower housing;

a driver, wherein the driver is configured for attachment to a sucker rod of the pumping system for reciprocating up stroke and down stroke movements, and wherein the driver is located within the housing and configured for limited upward and downward linear movement relative to the housing;

a rotary lock, wherein the rotary lock comprises a bottom wherein the bottom face is configured to rest against a seating face in the housing, wherein the rotary lock is in engagement with the driver for back and forth rotary motion as the driver makes the linear upward and downward motion relative to the housing such that when the driver undergoes the upward linear movement relative to the housing, the rotary lock rotates to close a fluid passage through the seating face to block fluid flow therethrough, and when the driver undergoes downward linear movement relative to the housing, the rotary lock rotates in an opposite direction to open the fluid passage through the seating face to allow fluid flow therethrough; and a back pressure spring, wherein the back pressure spring is configured to keep the bottom face of the rotary lock pressed against the seating face.

2. The valve according to claim 1, wherein the back pressure spring is housed in a spring retainer, and wherein the spring retainer and the back pressure spring in conjunction prevent longitudinal movement of the rotary lock during an up stroke of the driver.

3. The valve according to claim 1, wherein the valve further comprises a bearing between the back pressure spring and the rotary lock such that the rotary lock rotates freely in spite of the back pressure spring pushing against it.

4. The valve according to claim 1, further comprising a set of at least three driver alignment bearing balls.

5. The valve according to claim 4, wherein the set of at least three driver alignment bearing balls are fixed in the housing in at least three holes in the housing.

6. The valve according to claim 5, wherein the set of at least three driver alignment bearing balls protrude out towards an inside of the housing from the at least three holes and engage in longitudinal grooves.

7. The valve according to claim 5, wherein the valve further comprises an alignment set screw through or located in each of the at least three holes to adjust a position of each of the at least three driver alignment bearing balls and thereby adjust alignment of the driver relative to the housing.

8. The valve according to claim 1, wherein the engagement of the rotary lock with the driver for the back and forth rotary motion is through a set of helical grooves and a set of rotary lock bearing balls engaging in the set of helical grooves.

9. The valve according to claim 8, wherein the set of helical grooves is located on an outer periphery of the rotary lock.

10. The valve according to claim 9, wherein the set of rotary lock bearing balls is fixed on a surface of a bore in the driver in positions so as to engage with the set of helical grooves on the outer periphery of the rotary lock.

* * * * *